US011891222B2

(12) United States Patent
Ding

(10) Patent No.: US 11,891,222 B2
(45) Date of Patent: Feb. 6, 2024

(54) FLAT PLATE MEMBER AND PACKAGING BOX

(71) Applicant: ShenZhen YUTO Packaging Technology Co., Ltd., Shenzhen (CN)

(72) Inventor: Zhiyong Ding, Shenzhen (CN)

(73) Assignee: ShenZhen YUTO Packaging Technology Co., Ltd., Shenzhen (CN)

( * ) Notice: Subject to any disclaimer, the term of this patent is extended or adjusted under 35 U.S.C. 154(b) by 0 days.

(21) Appl. No.: 17/766,073

(22) PCT Filed: Dec. 22, 2021

(86) PCT No.: PCT/CN2021/140539
§ 371 (c)(1),
(2) Date: Apr. 1, 2022

(87) PCT Pub. No.: WO2023/108763
PCT Pub. Date: Jun. 22, 2023

(65) Prior Publication Data

US 2023/0182950 A1 Jun. 15, 2023

(30) Foreign Application Priority Data

Dec. 14, 2021 (CN) ..... 202111524134.X

(51) Int. Cl.
*B65D 5/06* (2006.01)
*B65D 5/42* (2006.01)
*B65D 5/02* (2006.01)

(52) U.S. Cl.
CPC ..... *B65D 5/06* (2013.01); *B65D 5/0209* (2013.01); *B65D 5/4266* (2013.01)

(58) Field of Classification Search
CPC ..... B65D 5/06; B65D 5/0209; B65D 5/4266; B65D 85/10484; B31B 50/252; B31F 1/08; B31F 1/10; B31F 1/0012
(Continued)

(56) References Cited

U.S. PATENT DOCUMENTS 2,586,301 A * 2/1952 Castle ..... B65D 5/4801 229/120.08
4,937,992 A * 7/1990 Dawson ..... B44F 11/06 428/167

(Continued)

FOREIGN PATENT DOCUMENTS

CN 101460377 A 6/2009
CN 202508375 U 10/2012

(Continued)

OTHER PUBLICATIONS

International Search Report dated Sep. 7, 2022 for PCT Application: PCT/CN2021/140539, 11 pages.

*Primary Examiner* — Christopher R Demeree
(74) *Attorney, Agent, or Firm* — Haverstock & Owens, A Law Corporation

(57) ABSTRACT

The present disclosure provides a flat plate member and a packaging box, the flat member includes a plurality of sidewall regions and a connection region connected between adjacent sidewall regions, the connection region is formed with a plurality of V-shaped grooves arranged at intervals in an arrangement direction of adjacent sidewall regions on a surface facing a first side. The plurality of V-shaped grooves extend along a direction of intersection lines between the sidewall regions and the connection region, and an included angle of the V-shaped grooves is set according to a slotting influence parameter, and the slotting influence parameter comprises at least one of a bending angle of the connection region, a material of the connection region, and a number of the V-shaped grooves.

17 Claims, 4 Drawing Sheets

(58) Field of Classification Search
USPC ..... 229/182.1, 930, 4.5; 428/130, 167
See application file for complete search history.

(56) References Cited

U.S. PATENT DOCUMENTS

| | | | | | |
|---|---|---|---|---|---|
| 4,955,531 | A * | 9/1990 | Graboyes | B31F 1/08 | 229/930 |
| 5,073,162 | A * | 12/1991 | Campbell | B31F 1/08 | 493/396 |
| 5,924,627 | A * | 7/1999 | Wilder | B65D 5/4266 | 229/930 |
| 7,044,294 | B2 * | 5/2006 | Lutzig | B65D 85/10484 | 206/266 |
| 8,608,051 | B2 * | 12/2013 | Focke | B65D 5/6691 | 206/259 |
| 10,266,301 | B2 * | 4/2019 | Rudolf | B65D 5/4266 | |
| 10,442,607 | B2 * | 10/2019 | Rudolf | B65D 85/10484 | |
| 10,486,894 | B2 * | 11/2019 | Rudolf | B65D 5/0209 | |

FOREIGN PATENT DOCUMENTS

| | | | |
|---|---|---|---|
| CN | 206485710 | U | 9/2017 |
| CN | 207860798 | U | 9/2018 |
| CN | 208102570 | U | 11/2018 |
| GB | 1411735 | A | 10/1975 |

* cited by examiner

FLAT PLATE MEMBER AND PACKAGING BOX

CROSS REFERENCES TO RELATED APPLICATION

The present disclosure is a national phase of PCT Application No. PCT/CN2021/140539 filed on Dec. 22, 2021 and claiming priority to Chinese Patent Application No. 202111524134.X, filed on Dec. 14, 2021 and titled by "FLAT PLATE MEMBER AND PACKAGING BOX", both of which are hereby incorporated by reference in their entireties.

TECHNICAL FIELD

The present disclosure relates to technical field of packaging containers, in particular to a flat plate member and a packaging box.

BACKGROUND

In the consumer electronics industry, rectangular rounded corners are the most common design; almost all the common consumer electronic products such as mobile phones, tablets, and power banks on the market heavily use the design element of the rectangular rounded corner in their appearance, which is also a design form most familiar to consumers, and easy to accept by consumers.

In the field of consumer electronics packaging, although many designers at home and abroad have tried to design the cuboid edges of the outer packaging into rounded corners with a certain radian, so as to express consistent and coordinated design elements of the inner product and the outer packaging, but this is difficult to achieve for most of cases except for a small amount of paper-plastic packaging and non-environmental-friendly plastic packaging, due to the limitations of the paper characteristic, production process and packaging equipment. Only on some low-end packaging such as paper boxes, a curved surface of the paper is formed by relatively rougher methods, but the curved surface is not easy to control and extremely inaccurate. Therefore, how to precisely control the curved surface of the packaging box should be considered by the person skilled in the art.

SUMMARY

For the above technical problems, the present disclosure provides a flat plate member and a packaging box, which can accurately control the curved surfaces of the packaging box.

To solve the above technical problems, the present disclosure provides a flat plate member, including: a plurality of sidewall regions; and a connection region connected between adjacent sidewall regions, the connection region being formed with a plurality of V-shaped grooves arranged at intervals in an arrangement direction of adjacent sidewall regions on a surface facing a first side, and the connection region being adapted to be bent so that the plurality of sidewall regions form a box body, wherein the plurality of V-shaped grooves extend along a direction of intersection lines between the sidewall regions and the connection region, and an included angle of the V-shaped grooves is set according to a slotting influence parameter, and the slotting influence parameter comprises at least one of a bending angle of the connection region, a material of the connection region, and a number of the V-shaped grooves.

In some embodiments, the plurality of V-shaped grooves have the same size and are arranged at equal intervals; and/or, a calculation formula of the included angle of the V-shaped grooves is as follows:

$$\theta v=(180-\theta_1)/n+k,$$

wherein θv is the included angle of the V-shaped grooves; $\theta_1$ is the bending angle of the connection region; n is the number of V-shaped grooves; and k is a corrected angle value determined according to the material of the connection region with a value range of 0°-7°.

In some embodiments, the material of the connection region includes at least one of a colloidal material and a paper material; when the connection region is made of the paper material, k is in a range of 3°-7°.

In some embodiments, the connection region comprises a first end and a second end respectively connected to two adjacent sidewall regions, and the plurality of V-shaped grooves are located between the first end and the second end; the first end is formed with a first bending portion facing the first side, and the first bending portion is adapted to form a first bending position between the connection region and one of the sidewall regions; the second end is formed with a second bending portion facing the first side, and the second bending portion is adapted to form a second bending position between the connection region and the other one of the sidewall regions; wherein the first bending portion and the second bending portion are both formed as recesses.

In some embodiments, a depth of the recesses is smaller than a depth of the V-shaped grooves.

In some embodiments, the plurality of V-shaped grooves have the same size and are arranged at equal intervals; the V-shaped grooves include a first V-shaped groove adjacent to the first end and a second V-shaped groove adjacent to the second end; a spacing between the first bending portion and the first V-shaped groove, a spacing between the second bending portion and the second V-shaped groove, and a spacing between adjacent two V-shaped grooves are all equal.

In some embodiments, the flat plate member further includes a reinforcement layer disposed on a side of the connection region facing away from the first side.

In some embodiments, the reinforcement layer is at least one of a film layer or a coating.

The embodiments of the present disclosure further provide a packaging box, including a box body formed by the above-mentioned flat plate member.

In some embodiments, the packaging box includes the body box, the body box includes a plurality of the side walls, the plurality of side walls are arranged in a first direction and enclose a through hole, at least a pair of adjacent side walls are connected by a curved connection section, and the curved connection section is formed by bending the connection region; the box body further includes a hole blocking assembly, including a first top piece and a second top piece, and the first top piece and the second top piece being respectively disposed on two openings of the through hole to form a closed structure, wherein the first top piece and the second top piece each include a piece body and a plurality of inserting pieces connected to an outer periphery of the piece body in a turnable piece, the piece body is connected to one of the side walls in a turnable manner, and the inserting pieces can protrude into the through hole and abut against the side walls on sides facing the through hole.

BRIEF DESCRIPTION OF THE DRAWINGS

The accompanying drawings, which are incorporated in and constitute a part of the specification, illustrate embodiments consistent with the present disclosure and serve to explain the principles of the present disclosure together with the specification. In order to illustrate the technical solutions of the embodiments of the present disclosure more clearly, the accompanying drawings required for the description of the embodiments will be briefly introduced below. Obviously, for the person skilled in the art, other accompanying drawings can be obtained according to these accompanying drawings without creative efforts.

REFERENCE NUMERALS

Figure 1:
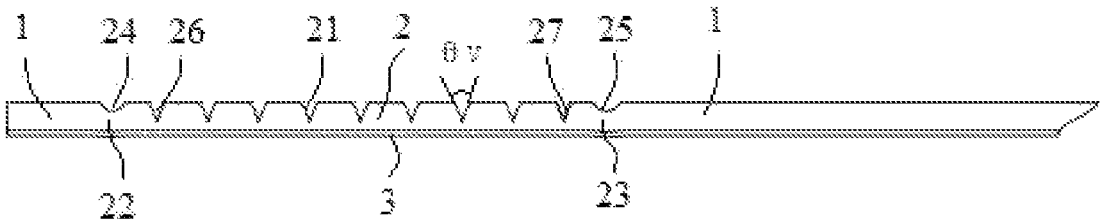
FIG. 1 is a partial structural schematic diagram of a flat plate member according to an embodiment of the present disclosure.

1, sidewall region;
2, connection region;
21, V-shaped groove;
22, first end;
23, second end;
24, first bending portion;
25, second bending portion;
26, first V-shaped groove;
27, second V-shaped groove;
3, reinforcement layer;
4, box body;
41, side wall;
42, curved connection section;
5, hole blocking assembly;
51, first top piece;
52, second top piece;
53, piece body;
54, inserting piece;
55, hanging portion;
56, first hanging wall;
57, second hanging wall;
58, hanging hole;
6, top piece region;
61, first top piece region;
62, second top piece region;
63, piece body region;
64, inserting piece region;
65, first hanging wall region;
66, second hanging wall region;
67, hanging hole.

The realization of the purpose, functional characteristics and advantages of the present disclosure will be further described with reference to the accompanying drawings in combination with the embodiments. Specific embodiments of the present disclosure have been shown by the above-mentioned accompanying drawings, and will be described in more detail hereinafter. These accompanying drawings and written descriptions are not intended to limit the scope of the concepts of the present disclosure in any way, but to illustrate the concepts of the present disclosure to the person skilled in the art by referring to specific embodiments.

DETAILED DESCRIPTION

Exemplary embodiments will be described in detail herein, examples of which are illustrated in the accompanying drawings. Where the following description refers to the drawings, the same numerals in different drawings refer to the same or similar elements unless otherwise indicated. The implementations described in the exemplary embodiments below are not intended to represent all implementations consistent with the present disclosure. Rather, they are merely examples of apparatus and methods consistent with some aspects of the present disclosure as recited in the appended claims.

In the description of the present disclosure, it should be noted that, unless otherwise stated, the meaning of "a plurality" is two or more; the orientations or positional relationships indicated by the terms "upper", "lower", "left", "right", "inner", "outer" and the like are merely for the purpose of describing the present disclosure and simplifying the description, and are not intended to indicate or imply that the device or component referred to has a particular orientation, is constructed and operated in a particular orientation, and therefore cannot be understood to be a limitation of the present disclosure. Moreover, the terms "first", "second", "third" and the like are used for descriptive purposes only and are not to be construed as indicating or implying relative importance.

The orientations appearing in the following description are all directions shown in the accompanying drawings and are not intended to limit the specific configuration of the present disclosure. In the description of the present disclosure, it should be noted that, unless otherwise specified and stated clearly, the terms "install", "connect", and "couple" are to be understood broadly, and may be, for example, a fixed connection, a disassemble connection, or an integral connection, and may be a direct connection or an indirect connection via an intermediate medium. The specific meaning of the above terms in the present disclosure can be understood by the person skilled in the art according to actual circumstance.

For a better understanding of the present disclosure, the embodiments of the present disclosure are described below with reference to FIGS. 1 to 6.

Figure 2:
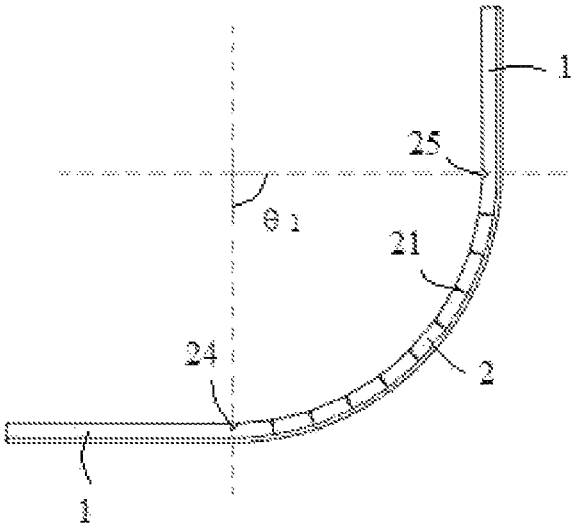
FIG. 2 is a partial structural schematic diagram of a flat plate member in a bent state according to an embodiment of the present disclosure.

FIG. 1 is a partial structural schematic diagram of a flat plate member according to an embodiment of the present disclosure, and FIG. 2 is a partial structural schematic diagram of a flat plate member according to an embodiment of the present disclosure in a bent state.

Referring to FIG. 1 and FIG. 2, the flat plate member provided by the embodiment of the present disclosure includes a plurality of sidewall regions 1 and a connection region 2 connected between adjacent sidewall regions 1; the connection region 2 is formed with a plurality of V-shaped grooves 21 arranged at intervals in an arrangement direction of adjacent sidewall regions 1 on a surface facing a first side, and the connection region 2 is adapted to be bent so that the plurality of sidewall regions 1 form a box body.

The plurality of V-shaped grooves 21 extend along a direction of intersection lines between the sidewall regions 1 and the connection region 2, and an included angle of the V-shaped grooves is set according to a slotting influence parameter, and the slotting influence parameter include at least one of a bending angle of the connection region 2, a material of the connection region 2, a number of the V-shaped grooves 21, and so on.

In an optional embodiment, a plurality of V-shaped grooves 21 extend across the entire connection region 2 along the direction of intersection lines between the sidewall regions 1 and the connection region 2.

It should be noted that the bending angle of the connection region 2 may refer to a included angle corresponding to two ends of the connection region 2 respectively connected to the adjacent sidewall regions 1 after the connection region 2 is bent, that is, if making vertical lines at the two ends, an included angle between the two vertical lines is the bending angle.

The included angle of the V-shaped grooves 21 is determined by the bending angle of the connection region 2, the material of the connection region 2, and the number of the V-shaped grooves 21. Specifically, the smaller the bending angle of the connection region 2 is, the larger the included angle of the V-shaped grooves 21 is, when the remaining variables are determined. The more the number of V-shaped grooves 21 is, the smaller the included angle of the V-shaped grooves 21 is, when the remaining variables are determined.

Further, the material of the connection region 2 is also critical to the included angle of the V-shaped grooves 21; for example, the included angle of the V-shaped grooves 21 when using a paper material is larger than the included angle of the V-shaped grooves 21 when using a colloidal material, if the remaining variables are determined. The colloidal material can be PVC and PET sheets, for example.

In the flat plate member provided by the embodiments of the present disclosure, the connection region 2 is added between the adjacent sidewall regions 1, the plurality of V-shaped grooves 21 are provided in the connection region 2, and the plurality of V-shaped grooves 21 are arranged at intervals in the arrangement direction of the adjacent sidewall regions 1 and extend along the direction of the intersection lines between the sidewall regions 1 and the connection region 2. As such, when bending the connection region 2 along the direction of the intersection lines between the sidewall regions 1 and the connection region 2 as shown in FIG. 2, the plurality of V-shaped grooves 21 will be deformed, two inclined walls of each V-shaped groove 21 approach toward each other, the space in each V-shaped groove 21 gradually becomes smaller, the originally flat and straight connection region 2 becomes curved, and the two adjacent sidewall regions 1 form two side walls, which are smoothly connected by the curved connection region 2.

Therefore, when forming a box body by use of the flat plate member provided by the embodiment of the present disclosure, an arc-shaped transition between adjacent side walls can be realized in the box body, and the curvature of each section in the connection region 2 can be precisely controlled by changing the arrangement manner of the V-shaped grooves 21, the bending angle of the connection region 2, the number of the V-shaped grooves 21 and the material of the connection region 21, to have a very little difference from that of a set curved surface, and thus, an accurate shaping of the curved surface between the side walls of the box body is realized. Moreover, when forming a packaging box by the above-mentioned box body, if electronic products with rectangular rounded corners are packaged by the box, the box has similar design elements with the products in the box, which greatly improves the aesthetics and sense of luxury of the packaging box, and improves the user experience.

It should be noted that, by changing the arrangement manner and angle of the V-shaped grooves 21, various types of curved surfaces can be formed, such as an arc-shaped curved surface with uniform curvature, a parabolic curved surface with inconsistent curvatures, and the like. The means for influencing the arrangement manner of the V-shaped grooves 21 include changing the number of the V-shaped grooves 21, changing the spacing among the respective V-shaped grooves 21, and changing the size of the V-shaped grooves 21.

For example, when a parabolic curved surface needs to be formed, the plurality of V-shaped grooves 21 are set to have a non-uniform density distribution, that is, the spacing of the plurality of V-shaped grooves 21 in each section (that is, the arrangement density of the V-shaped grooves 21 in each section) is calculated according to the curvature of the corresponding section, and the calculation and arrangement are performed individually for each section so as to form the curved surface in a desired shape.

In some optional embodiments, the plurality of V-shaped grooves 21 have the same size and are arranged at equal intervals.

In some optional embodiments, the calculation formula of the included angle of the V-shaped grooves 21 includes:

$$\theta v=(180-\theta_1)/n+k;\ \text{or}\ \theta v=(180-\theta_1)/n$$

wherein θv is the included angle of the V-shaped grooves 21; $\theta_1$ is the bending angle of the connection region; n is the number of the V-shaped grooves 21, and k is the corrected angle value determined according to the material of the connection region, with a value range of 0°-7°.

The plurality of V-shaped grooves 21 have the same size and are arranged at equal intervals, so that the connection region 2 can be bent into approximately a circular arc shape, that is, the two side walls are smoothly transitioned approximately with a circular arc-shaped transition, which further improves the aesthetics of the packaging box.

The included angle of the V-shaped grooves 21 calculated by the above formula can make the connection region 2 infinitely close to a circular arc shape after being bent.

When paper material is used and the calculation formula of the included angle of the V-shaped grooves 21 is $\theta v=(180-\theta_1)/n+k$, it is possible to avoid the reduction of the accuracy of the curved surface caused by bulging fibers in the V-shaped grooves 21. Specifically, fiber bulges may appear after the V-shaped grooves 21 are formed by cutting, and a certain elastic force may generated between the two inclined walls of the V-shaped grooves 21 after bending of the connection region 2. If the two inclined walls of the V-shaped grooves 21 are tightly abutted against each other after the bending of the connection region 2, the fiber bulges and the existence of the elastic force will lead to a large stress in the connection region 2, that is, the two inclined walls will apply a relatively large force on each other, and have a trend of moving away from each other; as a result, the actual bending angle of the connection region 2 will be greater than $\theta_1$, and the packaging box will be deformed. The existence of the k value can greatly avoid the occurrence of this situation, that is, the k value expands the angle of the V-shaped grooves 21 so that there is still a certain angle between the two inclined walls after the bending of the connection region 2, and thus there is a certain space to accommodate the fiber bulges and weaken the effect of the elastic force acting on the two inclined walls by each other; as such, the stress in the connection region 2 after bent will be greatly reduced, the bent shape of the connection region 2 is extremely stable, and the packaging box will almost not deform.

In some optional embodiments, the material of the connection region 2 includes at least one of a colloidal material and a paper material. When the connection region 2 is made of the paper material, k is in a range of 3°-7°.

Various types of paper materials can be used as the material of the flat plate member in the embodiments of the present disclosure, such as brown paper and card paper of various thicknesses and strengths. During production, the pre-folding process can be omitted due to the setting of the V-shaped grooves 21, which is convenient to bond and form the box body.

After lots of simulations, experiments and analyses to paper materials, the inventors have found that when the value of k is in the range of 3°-7° and under the condition that the remaining parameters remain unchanged, the obtained bent shape of the connection region 2 is relatively stable, that is, it will not make the stress to be still relatively large since k has a relatively small value, and will not make the connection region 2 to have a low strength and deform easily due to the excessive hollowing of the V-shaped grooves 21 since k has a relatively large value.

Still further, when the paper material is used, the value of k is 5°. After lots of simulations, experiments and analyses, the inventors have found that when the value of k is 5° and under the condition that the remaining parameters remain unchanged, the obtained bent shape of the connection region 2 is the most stable, that is, it will not make the stress to be still relatively large since k has a relatively small value, and will not make the connection region 2 to have a low strength and deform easily due to the excessive hollowing of the V-shaped grooves 21 since k has a relatively large value.

After lots of simulations, experiments and analysis, the inventors have found that when the value of $\theta_1$ is 90°, the value of k is 5°, the value of n is 9, and the value of θv is 15°, the bent shape of the connection region 2 is the most stable, the obtained circular arc shape is the most standard and beautiful, and the production difficulty is also low.

In some optional embodiments, when the connection region is made of a colloidal material, the value of k is in a range of 1°-3°.

The colloidal material includes PVC and PET sheets and other sheets, and since there are less fiber bulges after the V-shaped grooves are formed by cutting, thus the value of k is smaller compared to the value of k for the paper material. Further, the value of k is in a range of 1°-2°.

In some optional embodiments, the connection region 2 includes a first end 22 and a second end 23 respectively connected to adjacent two sidewall regions 1, and a plurality of V-shaped grooves 21 are located between the first end 22 and the second end 23. The first end 22 is formed with a first bending portion 24 facing a first side, and the first bending portion 24 is adapted to form a first bending position between the connection region 2 and one of the sidewall regions 1; and the second end 23 is formed with a second bending portion 25 facing the first side, and the second bending portion 25 is adapted to form a second bending position between the connection region 2 and the other one of the sidewall regions 1.

By forming the first bending portion 24 and the second bending portion 25 respectively at the first end 22 and the second end 23 of the connection region 2 to form the first bending position and the second bending position between the connection region 2 and the connected two sidewall regions 1, the flat plate member can be bent according to the first bending position and the second bending position when being bent, that is, an operation positioning is provided for the bending of the connection region 2, and thus the production efficiency is improved.

Further, each of the first bending portion 24 and the second bending portion 25 is formed as a recess.

After the connection region 2 is bent, the first end 22 and the second end 23 are very likely to form a certain angle with the straight side wall, and stress will be generated at the angle, thereby forming wrinkles; thus, by forming the first bending portion 24 and the second bending portion 25 as the recesses, most of the stress generated between the first and second ends 22, 23 and the straight side walls can be eliminated, and the wrinkles caused by the bending can be reduced, so that the first end 22 and the second end can be smoothly transitioned to the adjacent side walls respectively, thereby improving the aesthetics.

In an optional embodiment, the depth of the recess is smaller than the depth of the V-shaped grooves 21. With such configuration, the structural strength of the first end 22 and the second end 23 can be ensured, and meanwhile, the processing is simpler.

In an optional embodiment, the recess is formed as a U-shaped recess. Certainly, the recess further can be other types of recess, such as a V-shaped recess.

In an optional embodiment, the plurality of V-shaped grooves 21 have the same size and are arranged at equal intervals. The V-shaped grooves 21 include a first V-shaped groove 26 adjacent to the first end 22 and a second V-shaped groove 27 adjacent to the second end 23, and a spacing between the first bending portion 24 and the first V-shaped groove 26, a spacing between the second bending portion 25 and the second V-shaped groove 27, and a spacing between adjacent two V-shaped grooves 21 are all equal. It should be noted that the spacing between the first bending portion 24 and the first V-shaped groove 26 refers to a distance between the deepest point of the first bending portion 24 and the deepest point of the first V-shaped groove 26. Similarly, the spacing between the second bending portion 25 and the second V-shaped groove 27 refers to a distance between the deepest point of the second bending portion 25 and the deepest point of the second V-shaped groove 27.

The first bending portion 24, the plurality of V-shaped grooves 21 and the second bending portion 25 are arranged at equal intervals along the arrangement direction of the adjacent sidewall regions 1, so that the formed connection region 2 will be bent into a more standard circular arc shape with a more beautiful appearance.

Further referring to FIG. 1, in some optional embodiments, the straight plate member further includes a reinforcement layer 3, and the reinforcement layer 3 is disposed on a side of the connection region 2 facing away from the first side.

By providing the reinforcement layer 3 on the side of the connection region 2 facing away from the first side, the structural strength of the entire connection region 2 is improved. As a result, even with the plurality of V-shaped grooves 21 being digged, the flat plate member still has enough structural strength, so that it will not break during the subsequent bending process, and also has durability in the subsequent use process.

Further, the reinforcement layer 3 is at least one of a film layer and a coating. For example, it is a biaxially oriented polypropylene film.

In some optional embodiments, the V-shaped grooves 21 extend in a direction consistent with a direction of paper texture of a paperboard. In this way, the forming of the grooves is facilitated, and the formed V-shaped grooves 21 are smooth and not easily damaged.

Figure 3:
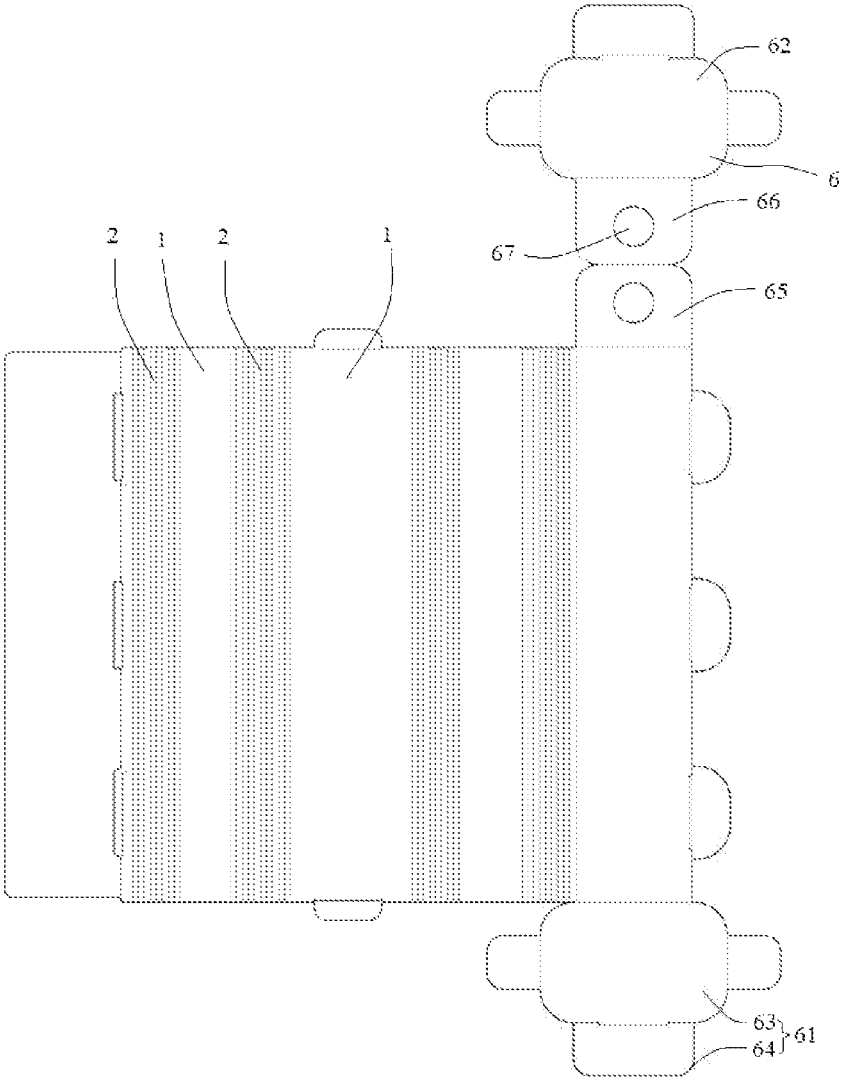
FIG. 3 is a schematic structural diagram of a flat plate member according to an embodiment of the present disclosure.

FIG. 3 is a schematic structural diagram of a flat plate member according to an embodiment of the present disclosure.

Referring to FIG. 3, in some optional embodiments, the flat plate member further includes a top piece region 6, and the top piece region 6 includes a first top piece region 61 and a second top piece region 62 respectively connected to two ends of the plurality of sidewall regions 1; the plurality of sidewall regions 1 are adapted to enclose a through hole, and the first top piece region 61 and the second top piece region 62 are adapted to respectively cover two openings of the through hole.

The first top piece region 61 and the second top piece region 62 each include a piece body region 63 and a plurality of inserting piece regions 64 connected to an outer periphery of the piece body region in a turnable manner, the piece body region 63 is connected with one of the sidewall regions 1 in a turnable manner, and the inserting piece regions 64 are adapted to abut against the first side of the sidewall region 1 when the packaging box is formed.

The first top piece region 61 and the second top piece region 62 may be connected to two ends of a same sidewall region 1, or may be connected to different sidewall regions 1.

In an optional embodiment, the second top piece region 62 further includes a hanging region, and the hanging region includes a first hanging wall region 65 and a second hanging wall region 66 that are symmetrically arranged and connected in a bendable manner; one end of the first hanging wall region 65 is connected to one of the sidewall regions 1 in a bendable manner, an opposite end of the first hanging wall region 65 is connected to a side of the second hanging wall region 66 close to the first hanging wall region 65 in a bendable manner, and an opposite side of the second hanging wall region 66 is connected to the piece body region 63 in a bendable manner.

In an optional embodiment, the first hanging wall region 65 and the second hanging wall region 66 are each provided with a hanging hole 67, and two hanging holes 67 can be aligned with each other when the first hanging wall region 65 and the second hanging wall region 66 are attached to each other. By providing the hanging region and the hanging holes, the packaging box can hang up conveniently.

Figure 4:
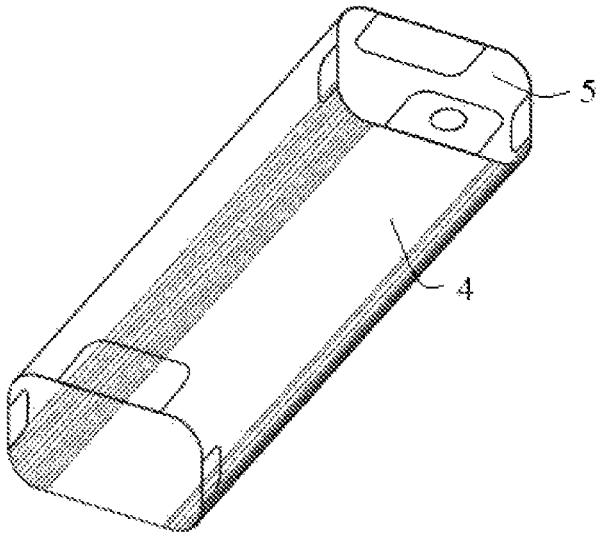
FIG. 4 is a schematic structural diagram of a packaging box formed by the flat plate member as shown in FIG. 3 in a closed state.
Figure 5:
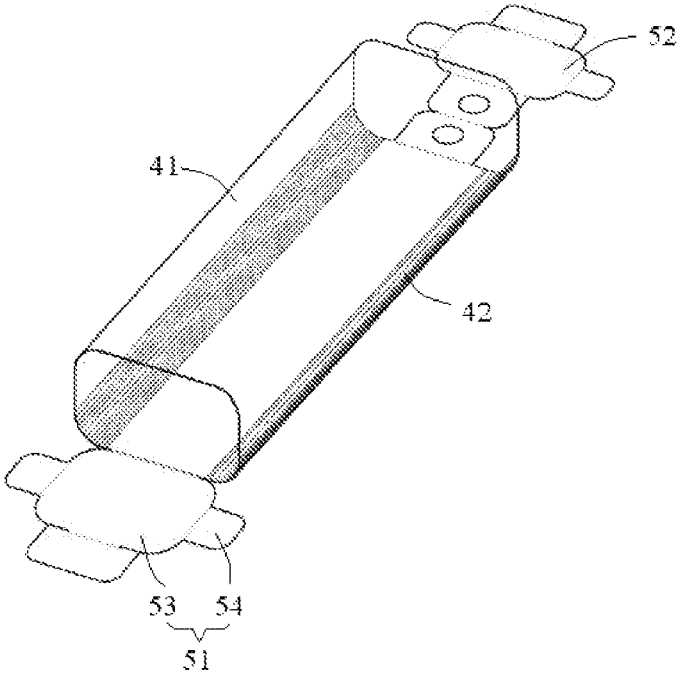
FIG. 5 is a schematic structural diagram of a packaging box formed by the flat plate member as shown in FIG. 3 in an open state.

FIG. 4 is a schematic structural diagram of the packaging box formed by the flat plate member as shown in FIG. 3 in a closed state, and FIG. 5 is a schematic structural diagram of a packaging box formed by the flat plate member as shown in FIG. 3 in an open state.

The embodiments of the present disclosure further provide a packaging box, including a box body 4 formed by the above-mentioned flat plate member.

Referring to FIG. 4 and FIG. 5, in some optional embodiments, the packaging box includes a box body 4 including a plurality of side walls 41, the plurality of side walls 41 are arranged in a first direction and enclose a through hole, at least one pair of adjacent side walls 41 are connected by a curved connection section 42, and the curved connection section 42 is formed by bending the connection region 2.

The box body 4 further includes a hole blocking assembly 5, the hole blocking assembly 5 includes a first top piece 51 and a second top piece 52, and the first top piece 51 and the second top piece 52 are respectively arranged on two openings of the through hole, so as to form a closed structure.

The first top piece 51 and the second top piece 52 each include a piece body 53 and a plurality of inserting pieces 54 connected to an outer periphery of the piece body 53 in a turnable manner, the piece body 53 is connected with one of the side walls 41 in a turnable manner, and the inserting pieces 54 can protrude into the through hole and abut against sides of the side walls 41 facing the through hole.

In an optional embodiment, the box body 4 includes four side walls 41, and any adjacent two side walls 41 are connected by a curved connection section 42.

In an optional embodiment, the piece body 53 has a same shape and size with an opening of the through hole, the piece body 53 can be bent at a joint portion with the side wall 41, and the plurality of inserting pieces 54 can be bent at a joint portion with the piece body 53.

In an optional embodiment, the number of the inserting pieces 54 is three, the through hole is substantially rectangular, and the three inserting pieces 54 are adapted to respectively abut against the remaining three side walls 41 of the four side walls 41 except the one connected with the piece body 53.

When the piece body 53 is turned to the opening position, the plurality of inserting pieces 54 can be inserted into the through hole. Due to the toughness and elasticity of the paperboard, the bent inserting pieces 54 can be firmly abutted on the sides of the side walls 41 facing the through hole, thereby stretching the plurality of side walls 41 while ensuring that the hole blocking assembly 5 does not slide out from the through hole, and thus solidifying the shape of the curved connection section 42 and preventing it from being naturally dented during use.

Figure 6:
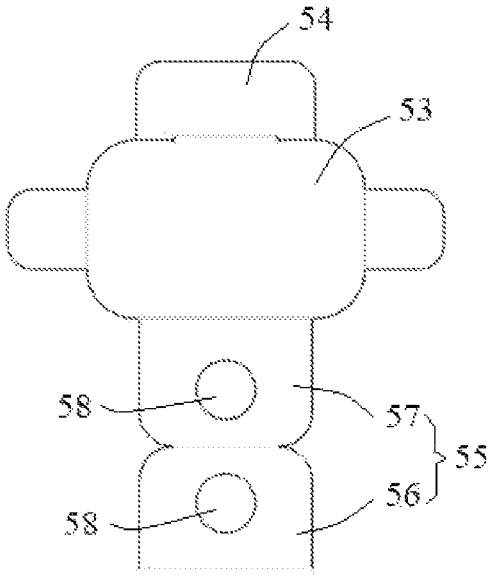
FIG. 6 is a schematic structural diagram of the second top plate as shown in FIG. 5.

FIG. 6 is a schematic structural diagram of the second top piece as shown in FIG. 5.

In an optional embodiment, the second top piece 52 further includes a hanging portion 55, and the hanging portion 55 includes a first hanging wall 56 and a second hanging wall 57 that are symmetrically arranged and connected in a bendable manner; a first end of the hanging wall 56 is connected to one of the side walls 41 in a turnable manner, a second end opposite to the first end of the hanging wall 56 is connected to a third end of the second hanging wall 57 in a turnable manner, and a fourth end of the second hanging wall 57 opposite to the third end is connected to the piece body 53 in a turnable manner.

In an optional embodiment, the first hanging wall 56 and the second hanging wall 57 are each provided with a hanging hole 58, and two hanging holes 58 are aligned when the first hanging wall 56 and the second hanging wall 57 are attached to each other. By providing the hanging holes 58, the packaging box can hang up conveniently.

The above are only the preferred embodiments of the present application, and are not intended to limit the scope of the patent of the present application. Any equivalent structure or equivalent process transformation made by using the contents of the specification and accompanying drawings of the present application, or directly or indirectly applications in other related technical fields, are similarly included in the scope of patent protection of the present application.

What is claimed is:

1. A flat plate member, comprising:

a plurality of sidewall regions; and a connection region connected between adjacent sidewall regions, the connection region being formed with a plurality of V-shaped grooves arranged at intervals in an arrangement direction of adjacent sidewall regions on a surface facing a first side, and the connection region being adapted to be bent so that the plurality of sidewall regions form a box body, wherein the plurality of V-shaped grooves extend along a direction of intersection lines between the sidewall regions and the connection region, and an included angle of the V-shaped grooves is set according to a slotting influence parameter, and the slotting influence parameter comprises at least one of a bending angle of the connection region, a material of the connection region, and a number of the V-shaped grooves, and wherein the connection region comprises a first end and a second end respectively connected to two adjacent sidewall regions, and the plurality of V-shaped grooves are located between the first end and the second end, the first end is formed with a first bending portion facing the first side, and the first bending portion is adapted to form a first bending position between the connection region and one of the sidewall regions, the second end is formed with a second bending portion facing the first side, and the second bending portion is adapted to form a second bending position between the connection region and the other one of the sidewall regions; wherein the first bending portion and the second bending portion are both formed as recesses.

2. The flat plate member according to claim 1, wherein the flat plate member has at least one of the following features:

the plurality of V-shaped grooves have the same size and are arranged at equal intervals; and a calculation formula of the included angle of the V-shaped grooves is as follows:

$$\theta_v=(180-\theta_1)/n+k,$$

wherein $\theta_v$ is the included angle of the V-shaped grooves; $\theta_1$ is the bending angle of the connection region; n is the number of V-shaped grooves; and k is a corrected angle value determined according to the material of the connection region with a value range of 0°-7°.

3. The flat plate member according to claim 2, wherein the material of the connection region comprises at least one of a colloidal material and a paper material;

when the connection region is made of the paper material, k is in a range of 3°-7°.

4. The flat plate member according to claim 1, wherein a depth of the recesses is smaller than a depth of the V-shaped grooves.

5. The flat plate member according to claim 1, wherein the plurality of V-shaped grooves have the same size and are arranged at equal intervals;

the V-shaped grooves comprise a first V-shaped groove adjacent to the first end and a second V-shaped groove adjacent to the second end;

a spacing between the first bending portion and the first V-shaped groove, a spacing between the second bending portion and the second V-shaped groove, and a spacing between adjacent two V-shaped grooves are all equal.

6. The flat plate member according to claim 1, further comprising a reinforcement layer disposed on a side of the connection region facing away from the first side.

7. The flat plate member according to claim 6, wherein the reinforcement layer is at least one of a film layer or a coating.

8. A packaging box, comprising a box body formed by the flat plate member according to claim 1.

9. The packaging box according to claim 8, wherein:

the box body comprises a plurality of the side walls, the plurality of side walls are arranged along a first direction and enclose a through hole, at least a pair of adjacent side walls are connected by a curved connection section, and the curved connection section is formed by bending the connection region;

the box body further comprises:

a hole blocking assembly, comprising a first top piece and a second top piece, and the first top piece and the second top piece being respectively disposed on two openings of the through hole to form a closed structure, wherein the first top piece and the second top piece each comprise a piece body and a plurality of inserting pieces connected to an outer periphery of the piece body in a turnable manner, the piece body is connected to one of the side walls in a turnable manner, and the inserting pieces can protrude into the through hole and abut against the side walls on sides facing the through hole.

10. The packaging box according to claim 8, wherein the flat plate member has at least one of the following features:

the plurality of V-shaped grooves have the same size and are arranged at equal intervals; and a calculation formula of the included angle of the V-shaped grooves is as follows:

$$\theta_v=(180-\theta_1)/n+k,$$

wherein $\theta_v$ is the included angle of the V-shaped grooves; $\theta_1$ is the bending angle of the connection region; n is the number of V-shaped grooves; and k is a corrected angle value determined according to the material of the connection region with a value range of 0°-7°.

11. The packaging box according to claim 10, wherein the material of the connection region comprises at least one of a colloidal material and a paper material;

when the connection region is made of the paper material, k is in a range of 3°-7°.

12. The packaging box according to claim 8, wherein a depth of the recesses is smaller than a depth of the V-shaped grooves.

13. The packaging box according to claim 8, wherein the plurality of V-shaped grooves have the same size and are arranged at equal intervals;

the V-shaped grooves comprise a first V-shaped groove adjacent to the first end and a second V-shaped groove adjacent to the second end;

a spacing between the first bending portion and the first V-shaped groove, a spacing between the second bending portion and the second V-shaped groove, and a spacing between adjacent two V-shaped grooves are all equal.

14. The packaging box according to claim 8, further comprising a reinforcement layer disposed on a side of the connection region facing away from the first side.

15. The packaging box according to claim 14, wherein the reinforcement layer is at least one of a film layer or a coating.

16. The packaging box according to claim 8, wherein the included angle of the V-shaped grooves is set according to the bending angle of the connection region, the material of the connection region, and the number of the V-shaped grooves.

17. The flat plate member according to claim 1, wherein the included angle of the V-shaped grooves is set according to the bending angle of the connection region, the material of the connection region, and the number of the V-shaped grooves.

* * * * *